US012252815B2

(12) United States Patent
Hu

(10) Patent No.: US 12,252,815 B2
(45) Date of Patent: Mar. 18, 2025

(54) CUT RESISTANT PLY-TWISTED YARNS AND FABRICS MADE THEREOF

(71) Applicant: DUPONT SAFETY & CONSTRUCTION, INC., Wilmington, DE (US)

(72) Inventor: Yingxiang Hu, Shanghai (CN)

(73) Assignee: DUPONT SAFETY & CONSTRUCTION, INC., Wilmington, DE (US)

( * ) Notice: Subject to any disclaimer, the term of this patent is extended or adjusted under 35 U.S.C. 154(b) by 905 days.

(21) Appl. No.: 17/009,385

(22) Filed: Sep. 1, 2020

(65) Prior Publication Data

US 2021/0071323 A1 Mar. 11, 2021

(30) Foreign Application Priority Data

Sep. 6, 2019 (CN) ..... 201910841636.1

(51) Int. Cl.

| | |
|---|---|
| ***D02G 3/44*** | (2006.01) |
| ***A41D 19/015*** | (2006.01) |
| ***A41D 31/24*** | (2019.01) |
| ***D02G 3/04*** | (2006.01) |
| ***D02G 3/12*** | (2006.01) |
| ***D02G 3/36*** | (2006.01) |
| *D04B 1/28* | (2006.01) |
| *D04B 21/20* | (2006.01) |

(52) U.S. Cl.

CPC ..... *D02G 3/442* (2013.01); *A41D 19/01505* (2013.01); *D02G 3/047* (2013.01); *D02G 3/12* (2013.01); *D02G 3/36* (2013.01); *A41D 31/24* (2019.02); *A41D 2500/10* (2013.01); *D04B 1/28* (2013.01); *D04B 21/207* (2013.01); *D10B 2101/20* (2013.01); *D10B 2331/021* (2013.01); *D10B 2331/10* (2013.01); *D10B 2501/041* (2013.01)

(58) Field of Classification Search

CPC ..... D02G 3/442; D02G 3/04; D02G 3/12; D02G 3/36; A41D 19/01505; A41D 31/24; D10B 2101/20; D10B 2331/021; D10B 2331/10

See application file for complete search history.

(56) References Cited

U.S. PATENT DOCUMENTS

| | | | | |
|---|---|---|---|---|
| 6,534,175 | B1 | 3/2003 | Zhu et al. | |
| 6,952,915 | B2 | 10/2005 | Prickett | |
| 2019/0055676 | A1* | 2/2019 | Chen | D04B 15/56 |

* cited by examiner

*Primary Examiner* — Joanna Pleszczynska

(57) ABSTRACT

The present invention provides a multi-ply twisted yarn for a cut-resistant fabric, and the multi-ply twisted yarn comprises (i) at least a first single yarn having a skin-core structure, wherein the skin comprises aromatic polyamide staple fibers and the core comprises tungsten filaments, and (ii) at least a second single yarn having a skin-core structure, wherein the skin comprises cut-resistant staple fibers, the core comprises at least an elastomer filament, and the cut-resistant staple fibers of the second single yarn are selected from one or more of aromatic polyamide staple fibers, aliphatic polyamide staple fibers and polyethylene staple fibers. The present invention further provides a cut-resistant fabric comprising the multi-ply twisted yarn and a protective product comprising the cut-resistant fabric.

12 Claims, 1 Drawing Sheet

CUT RESISTANT PLY-TWISTED YARNS AND FABRICS MADE THEREOF

TECHNICAL FIELD

The present invention relates to multi-ply twisted yarns for a cut-resistant fabric and the cut-resistant fabric made thereof, and the cut-resistant fabric is not only comfortable, soft and flexible, but also extraordinarily cut resistant.

BACKGROUND ART

Industrial practitioners, policemen and soldiers may directly contact various types of steel plates, irons, knives, sharp apparatuses, fragments, cullet and wire nets when they work, and therefore they need to wear cut-resistant protective products such as protective gloves. Especially, for the practitioners in heavy industries, for example, the professionals engaged in extreme mechanical operations or steel plate finishing and cutting, the protective gloves they need to wear require a high cut resistance equal to or higher than ANSI/ISEA 105 level A6, or equal to or higher than EN388 2016 level F. However, current protective gloves at this level are hard and thick, although the cut resistance can satisfy the requirement. The hardness and rigidity greatly restrict the motion flexibility and comfort of the wearer.

Therefore, it is ideal to develop a fabric which is not only comfortable, soft and flexible, but also cut-resistant, and use it for producing protective gloves and other protective products.

SUMMARY OF THE INVENTION

The present invention provides multi-ply twisted yarns for a cut-resistant fabric, and the yarns comprise:

(i) at least a first single yarn having a skin-core structure, wherein the skin comprises aromatic polyamide staple fibers and the core comprises tungsten filaments, and (ii) at least a second single yarn having a skin-core structure, wherein the skin comprises cut-resistant staple fibers, the core comprises at least an elastomer filament, and the cut-resistant staple fibers of the second single yarn are selected from one or more of aromatic polyamide staple fibers, aliphatic polyamide staple fibers and polyethylene staple fibers.

The present invention further provides a cut-resistant fabric comprising the multi-ply twisted yarns and a protective product comprising the cut-resistant fabric. The protective product may be a protective glove, protective clothing, a protective vest, a protective cap, an armguard, a protective blanket, a protective curtain, a protective shoe, work clothing, or sports wear.

DETAILED DESCRIPTION OF THE INVENTION

Figure 1:
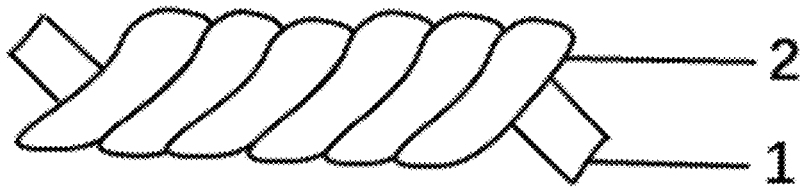
FIG. 1 shows one embodiment of multi-ply twisted yarns of the present invention.

If not specified separately, all publications, patent applications, patents and other reference documents mentioned in the description will expressly be incorporated by reference into the description in their entirety for all purposes, as completely published here.

Unless otherwise defined, all technical and scientific terms used in the description have the same meanings as understood by those skilled in the art. In the case of any conflict, their meanings are subject to the definitions in the description.

Unless otherwise specified, all the percentages, portions, ratios, etc. mentioned herein are measured by weight.

As used in this Description, the term "made of . . . " is synonymous with the term "comprising". As used in this Description, the term "comprising", "including", "provided with", "containing" or any other variant thereof is intended to cover non-exclusive inclusions. For example, a compound, process, method, product, or instrument comprising a series of elements is not necessarily limited to those elements and instead may include other elements not expressly listed or other elements intrinsic to such a compound, process, method, product, or instrument.

The connective "composed of . . . " does not include any unspecified elements, steps, or components. In the claims, such a connective confines the claims to the listed materials except common impurities concomitant therewith. When the phrase "composed of" appears in a subordinate clause of the characteristic part in the claims, instead of immediately following the preorder part, it only limits the elements listed in the subordinate clause, and other elements are not excluded from the entirety of the claims.

The connective "basically composed of . . . " is used to limit a compound, method, or instrument, excluding materials, steps, characteristics, components, or elements other than those discussed literally, on condition that these additional materials, steps, characteristics, components, or elements do not substantially affect any basic and novel characteristics of the claimed invention. The term "basically composed of . . . " defines an intermediate scope between "comprising" and "composed of . . . .".

The term "containing" includes embodiments covered by the terms "basically composed of . . . " and "composed of . . . ". Similarly, the term "basically composed of . . . " includes embodiments covered by the term "composed of . . . ".

When quantities, concentrations, or other values or parameters are provided as a list of ranges, preferred ranges or preferred upper limits and preferred lower limits, it should be understood that all ranges formed by any pair of range upper limits or preferred values and range lower limits or preferred values, regardless of whether ranges are disclosed separately.

For example, when the range of "1 to 5" is listed, it should be understood that the disclosed ranges include "1 to 4", "1 to 3", "1 to 2", "1 to 2 and 4 to 5", and "1 to 3 and 5". In this Description, when a numerical range is listed, unless otherwise specified, the range is intended to include the endpoints of the range and all integers and fractional numbers within the range.

When the term "about" is used to describe a value or an endpoint of a range, the present disclosure should be construed as including the indicated specific value or endpoint.

In addition, unless expressly stated otherwise, "or" refers to inclusive "or", instead of exclusive "or". For example, any of the following meets the condition of A "or" B: A is true (or exists) and B is false (or does not exist), A is false (or does not exist) and B is true (or exists), and A and B are true (exist).

Mol % refers to molar percent.

In the Description and claims of the present invention, the term "homopolymer" refers to a polymer obtained by polymerization of a repeating unit. For example, the term "poly-p-phenylene terephthamide homopolymer" refers to a polymer basically composed of a repeating unit "p-phenylene terephthamide". As used in this Description, the term "copolymer" refers to a copolymer of a copolymerization unit obtained by copolymerization of two or more types of co-monomers.

As used in this Description, the term "fiber" is defined as a relatively flexible and extended object that has a high ratio of a length to the width of a cross section perpendicular to the length. A fiber cross section may be of any shape, for example, circular, flat, or elliptical, but generally circular. A fiber cross section may be solid or hollow, preferably solid. A fiber may be a filament or staple fiber.

The term "filament" refers to artificial continuous fiber obtained by passing a chemical spinning solution through a spinning nozzle, with a length of up to several hundred meters.

The term "staple fiber" refers to one of the short fiber segments into which a fiber may be cut; it may be natural fiber, for example, cotton, hemp, or fur, or may be one of the short fibers into which a filament is cut, with a specified length about 10 mm to 300 mm.

As used in this Description, the term "yarn" is defined as a single ply that is composed of a plurality of fibers and formed by twisting staple fibers and/or filaments.

As used in this Description, the term "multi-ply twisted yarns" is defined as being prepared by twisting together at least two types of separate single yarns; the term "twisting together at least two types of separate single yarns" refers to twisting together two types of single yarns, but no type of yarns completely covers another type of yarns, which allows the term "multi-ply twisted yarns" to be distinguishable from "wrap yarn" or "covered yarn". In a wrap yarn or covered yarn, a first single yarn completely covers the periphery of a second single yarn so that only the first single yarn emerges out of the surface of obtained multi-ply twisted yarns.

As used in this Description, the term "twisting" refers to causing the two cross sections of a sliver to rotate relative to each other, so that the fibers in the sliver, originally parallel to the yarn axis, tilt to form a helix. The extent of twisting is characterized by "twist factor", which refers to the number of twists required for each unit length to aggregate staple fibers and/or filaments; twisting and turning yarns by one round is one twist, namely, a twist round. Twist factor may be defined by any one of a plurality of dimensions and "twist factor" as used in this Description is defined by the number of twist rounds of yarns within a length of 100 cm, measured in twists per meter (TPM).

After fibers in a single yarn or single yarns in a ply are twisted, a twist having a bottom-up and right-to-left twist round is known as an S twist, while a twist having a bottom-up and left-to-right twist round is known as a Z twist.

As used in this Description, the fineness of a fiber or yarn is generally expressed by diameter or linear density (dtex); dtex indicates the weight, in grams, of a fiber or yarn that is 10,000 meters long at a public moisture regain.

The embodiments of the present invention described in section "Summary of the Invention" of the present invention include any other embodiment described in this Description and may be combined in any way; in addition, the subject descriptions in the embodiments involve not only multi-ply twisted yarns and cut-resistant fabric of the present invention but also other prepared protective products.

The present invention will be described in detail below.

FIG. 1 shows one embodiment of multi-ply twisted yarns of the present invention, which comprises a first single yarn 1 having a skin-core structure and a second single yarn 2 having a skin-core structure.

Figure 2:
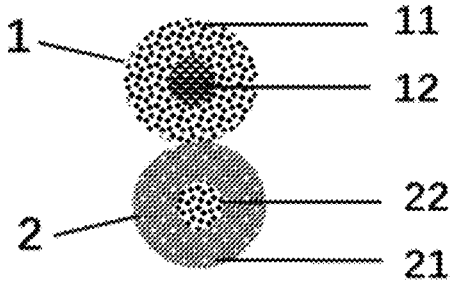
FIG. 2 is a cutaway view of one embodiment of multi-ply twisted yarns of the present invention.

FIG. 2 is a cutaway view of one embodiment of multi-ply twisted yarns of the present invention, wherein the skin of the first single yarn 1 having a skin-core structure is an aromatic polyamide staple fiber 11 and the core is a tungsten filament 12; the skin of the second single yarn 2 having a skin-core structure is a cut-resistant staple fiber 21 and the core is an elastomer filament 22.

First Single Yarn

In the present invention, the first single yarn is a single yarn having a skin-core structure, wherein the skin comprises aromatic polyamide staple fibers and the core comprises filaments made of metallic tungsten, namely, tungsten filaments; based on the total weight of the first single yarn, the content of aromatic polyamide staple fibers is about 45 wt % to 75 wt %, and the content of tungsten filaments is about 25 wt % to 55 wt %.

As used in this Description, the term "skin-core structure" means that the skin (namely, the aromatic polyamide staple fibers) completely or partially covers the core (namely, the tungsten filaments) for spinning into a single yarn. An objective of the use of a skin-core structure is to cover and protect tungsten filaments with aromatic polyamide staple fibers, thus preventing direct friction or contact between a tungsten filament and another material and also allowing fabric that comprises such yarns to have improved comfort.

In the skin-core structure, covering or spinning of an aromatic polyamide staple fiber on the periphery of a tungsten filament is achievable by a known method, for example, ring spinning, core spinning, jet spinning, or free end spinning. Preferably, an aromatic polyamide staple fiber is congealed on the periphery of a tungsten filament at a density sufficient to cover the core. The degree of coverage depends on the spinning method used. In conventional ring spinning, only most of the central core is covered; however, even if partially covered, it is deemed to be a skin-core structure applicable to an objective of the present invention. The skin may further contain fibers made of certain other materials, to the degree of being able to bear a decrease in cut resistance caused by another material.

In the present invention, the aromatic polyamide staple fiber has a length of about 20 mm to 200 mm or about 35 mm to 60 mm, a diameter of about 5 μm to 25 μm, and a linear density of about 0.5 dtex to 7 dtex or about 1.5 dtex to 3 dtex.

In the present invention, the aromatic polyamide staple fibers may be para-aromatic polyamide staple fibers, meta-aromatic polyamide staple fibers, group butyl copolymer (p-phenylene/3,4 diphenyl ether benzenedicarboxamide) staple fibers, poly(imide-benzoxazole) staple fibers, or a mixture thereof, preferably, para-aromatic polyamide staple fibers. Para-aromatic polyamide staple fiber refers to staple fiber made of para-aromatic polyamide, and the term "para-aromatic polyamide" refers to poly(p-phenylene terephthamide) homopolymer and poly(p-phenylene terephthamide) copolymer. A poly(p-phenylene terephthamide) homopolymer is derived by equimolar polymerization of para-phenylene diamine (PPD) and terephthalyl chloride (TCl). A poly(p-phenylene terephthamide) copolymer is derived by incorporating up to 10 Mol % of other diamines into diaminobenzene and incorporating up to about 10 Mol % of other diacyl chlorides into TCl, on condition that the other diamines and diacyl chlorides have no reactive groups that interfere with polyreaction. Examples of diamines other than diaminobenzene include, but are not limited to, meta-diaminobenzene or 3,4'-diaminodiphenyl ether (3,4'-ODA). Examples of diacyl chlorides other than TCl include, but are not limited to, isophthaloyl dichloride, 2,6-naphthoyl chloride, chloro terephthaloyl chloride, or dichloroterephthaloyl chloride. The above-described para-aromatic polyamide may be spun into a fiber by solution spinning. Fiber spinning is achievable by air spinning, wet spinning, or dry blast wet spinning (also known as air-gap spinning) with a porous spinning nozzle. Then, as needed, spun fibers may be treated by routine technology to neutralize, clean, dry, or thermally treat the fibers, thereby preparing stable and useful fibers and/or staple fibers.

Aromatic polyamide staple fibers are commercially available, for example, Kevlar® provided by DuPont Specialty Products US, LLC (hereinafter referred to as "DuPont"), Twaron® or Technor® provided by Teijin, or Zylon® provided by Toyobo.

In the present invention, the tungsten filament may be a monofilament or a multifilament, preferably a single filament or a plurality of filaments, depending on the needs or requirements in specific circumstances. The tungsten filament has a diameter of about 1 μm to 150 μm, or about 10 μm to 75 μm, or about 22 μm to 38 μm, or about 25 μm to 35 μm, or about 28 μm to 32 μm.

Second Single Yarn

In the present invention, the second single yarn is a single yarn having a skin-core structure, wherein the skin comprises cut-resistant staple fibers, and the core comprises at least an elastomer filament, the elastomer filament being completely or partially coverable by the cut-resistant staple fibers comprised by the skin, based on the total weight of the second single yarn, the content of cut-resistant staple fibers is about 75 wt % to 98 wt %, and the content of elastomer filament is about 2 wt % to 25 wt %.

In the second single yarn having the skin-core structure in the present invention, covering or spinning of a cut-resistant staple fiber on the periphery of the elastomer filament is achievable by a known method, for example, ring spinning, core spinning, jet spinning, or free end spinning. Preferably, a cut-resistant staple fiber is congealed on the periphery of the elastomer filament at a density sufficient to cover the core.

In the present invention, the elastomer filament is preferably a polyurethane elastomer filament, also known as "Spandex filament", which refers to a manufactured fiber, in which the fiber-forming substance is a long-chain synthetic elastomer containing at least 85 wt % block polyurethane. Such polyurethane is prepared by a mixture of polyether diols and diisocyanates, as well as a chain extender, and then is spun into an elastomer filament by melt spinning, dry spinning, or wet spinning. By one of certain methods for manufacturing a polyurethane elastomer filament, a polyurethane elastomer filament, once extruded, is congealed with an agglutinating jet. A dry-spun polyurethane elastomer filament is sticky when just extruded. Agglutinant multifilament yarns are generated by a combination of forming a group of such sticky filaments and using an agglutinating jet and then generally coated with a silicone resin or any other finishing agent before coiling to prevent them from adhering to the coil. Such an agglutinant filament group, which actually contains many fine separate filaments adhered to one another along its length, is, in many aspects, superior to a polyurethane elastomer filament that has the same linear density. In the present invention, the polyurethane elastomer filament may exist in a polyurethane elastomer single yarn in the form of one or more separate filaments or one or more groups of agglutinant filaments, preferably with only one group of agglutinant filaments. Existent in the form of one or more separate filaments or in the form of one or more groups of agglutinant filaments, a polyurethane elastomer filament in a relaxed state generally has a total linear density of about 22 dtex to 220 dtex, or about 33 dtex to 110 dtex, or about 44 dtex to 77 dtex. Preferably, at a transfer speed of a polyurethane elastomer fiber that is slower than the final polyurethane elastomer single yarn, before combination with a staple fiber, by stretching or extension of the fiber, the elastomer fiber is mixed by a tensile force into the polyurethane elastomer single yarn. Such stretching may be described as a ratio of elongation of polyurethane elastomer fibers, which is the speed of the final polyurethane elastomer single yarns divided by the transfer speed of the polyurethane elastomer fibers. A typical ratio of elongation is 1.5 to 5.0, preferably 1.5 to 3.5. If the ratio of elongation is low, relatively low elastic resilience is produced; if the ratio of elongation is very high, it is difficult to process single yarns, and the manufactured fabric will be too tight and uncomfortable.

The most suitable ratio of elongation further depends on the percentage by weight of the polyurethane elastomer core. Further, a tensile device may be used to tighten and elongate polyurethane elastomer fibers, but it is less preferred because it is difficult to reproduce and control tensile force and elongation. The most suitable ratio of elongation for a type of fabric may be finally determined on the basis of the ideal conformality of and feel provided by the fabric.

In the present invention, the cut-resistant staple fibers are selected from one or more of aromatic polyamide staple fibers, aliphatic polyamide staple fibers, polyester staple fibers, and polyethylene staple fibers. In the present invention, aromatic polyamide staple fibers may be para-aromatic polyamide staple fibers or meta-aromatic polyamide staple fibers, preferably para-aromatic polyamide staple fibers; the aliphatic polyamide staple fibers may be polyamide-6 (PA-6) staple fibers or polyamide-66 (PA-66) staple fibers; the polyester staple fibers may be polyethylene terephthalate (PET) staple fibers; and the polyethylene staple fibers may be ultra-high molecular weight polyethylene (UHMWPE) staple fibers.

Multi-Ply Twisted Yarns

In the present invention, the multi-ply twisted yarns are formed by twisting together at least one type of first single yarns and at least one type of second single yarns. Generally, multi-ply twisted yarns of the present invention are manufactured by a two-step method or a combination method. For example, in step 1 of the two-step method, two or more single yarns are combined (without multi-ply twisting) parallel to each other and coiled on a coil. In the next step, two or more combined yarns are ring-spun together by S twists to form multi-ply twisted yarns. Multi-ply twisted yarns generally have "Z" twists (single yarns generally have "S" twists). Alternatively, single yarns may be multi-ply twisted by a combination method in which these two steps are combined in a single operation. In the present invention, single yarns have a twist factor of about 400 TPM to 850 TPM, and multi-ply twisted yarns have a twist factor of 200 TPM to 400 TPM.

Then, multi-ply twisted yarns may be combined with other multi-ply twisted yarns that are the same as or different from them, thereby forming a yarn bundle for generating fabric, or separate multi-ply twisted yarns may be used to form cut-resistant fabric, wherein a "yarn bundle" is one or more multi-ply twisted yarns, or a plurality of single yarns, or a combination of multi-ply twisted yarns and single yarns. Preferably, a yarn bundle has 1 to 3 multi-ply twisted yarns, and the multi-ply twisted yarns or single yarns in a yarn bundle or fabric are not necessarily precisely the same. In addition, a yarn bundle may only contain single yarns that, instead of being multi-ply twisted, are simply combined as a yarn bundle to be fed into a robot for manufacturing knitted fabric.

In the present invention, the multi-ply twisted yarns are prepared by multi-ply twisting at least one type of first single yarns and at least one type of second single yarns, the multi-ply twisted yarns having a total linear density of about 150 dtex to 1000 dtex, or about 240 dtex to 850 dtex. Multi-ply twisted yarns and single yarns for preparing multi-ply twisted yarns may also comprise other materials, as long as the functions and performance delivered by the yarns or fabric made by the yarns in a needed application remain unaffected.

Cut-Resistant Fabric and Protective Product Comprising the Multi-Ply Twisted Yarn In the present invention, the cut-resistant fabric comprising the multi-ply twisted yarn can be made by use of knitting or weaving, and a cut resistance, a puncture resistance and a comfort are realized by regulating the knitting tightness.

In the present invention, the protective product comprising the multi-ply twisted yarn or cut-resistant fabric can directly be made by use of knitting or weaving, or can be made by first making the multi-ply twisted yarn into a cut-resistant fabric by use of knitting or weaving and then stitching, bonding and cutting the fabric. The protective product can be a protective glove, protective clothing, a protective vest, a protective cap, an armguard, a protective blanket, a protective curtain, a protective shoe, work clothing, or sports wear. For example, the multi-ply twisted yarn can directly be made into a protective glove by use of knitting. Any proper knitted pattern is acceptable to the cut-resistant fabric made by use of knitting.

In the present invention, a glove knitting machine or circular knitting machine with a proper number of needles (for example, a glove knitting machine with 13 needles, 15 needles, 18 needles or 21 needles, or a circular knitting machine with 20 needles or 24 needles) can be used to knit the multi-ply twisted yarn into a cut-resistant fabric or a protective glove by use of knitting. A knitting machine with 20 or more needles can be selected for the multi-ply twisted yarn with a linear density less than 300 dtex, a knitting machine with 18 needles can be selected for the multi-ply twisted yarn with a linear density approximately between 300 dtex and 500 dtex, a knitting machine with 15 needles can be selected for the multi-ply twisted yarn with a linear density approximately between 500 dtex and 600 dtex, and a knitting machine with 13 needles can be selected for the multi-ply twisted yarn with a linear density approximately between 600 dtex and 850 dtex. If the selected knitting machine has fewer needles, the manufactured cut-resistant fabric or protective glove is thinner, more flexible and more comfortable.

In one embodiment, the cut-resistant fabric comprising the multi-ply twisted yarn of the present invention has a basic weight of about 100 g/m$^2$ to 500 g/m$^2$ or 200 g/m$^2$ to 400 g/m$^2$, and a thickness of about 0.8 mm to 2.0 mm.

The cut resistance of the cut-resistant fabric and protective product of the present invention is determined according to the standard method in ISO 13997. A cut resistance tester TDM-100 is used to test the cutting force in N of a fabric sample knitted by use of 100% multi-ply twisted yarn to be tested. A large cutting force indicates a high cut resistance of the fabric. The cutting force is divided by the basic weight of the fabric and then is multiplied by 100 to obtain a cutting force index in N/g/m$^2$.

The cut level of the cut-resistant fabric or protective product in ANSI/ISEA105 or EN388 2016 can be obtained according to the cutting force of the cut-resistance fabric or protective product of the present invention. According to ANSI/ISEA105, a load is exerted on a sharp straight-edged blade, and by the maximum load in grams (g), which can be exerted on the blade to ensure that a sample is not cut through after a 20-mm cutting distance of the blade, the cut resistance of the fabric can be classified into nine levels of level A1 to level A9, as listed in Table 1.

Accordingly, the cutting force, namely, the maximum force, can be obtained by multiplying the maximum load by 9.8 N/Kg, as listed in Table 1.

TABLE 1

| Cut level | A1 | A2 | A3 | A4 | A5 | A6 | A7 | A8 | A9 |
|---|---|---|---|---|---|---|---|---|---|
| Cut load (g) | ≥200 | ≥500 | ≥1000 | ≥1500 | ≥2200 | ≥3000 | ≥4000 | ≥5000 | ≥6000 |
| Cutting force (N) | ≥1.96 | ≥4.9 | ≥9.8 | ≥14.7 | ≥21.56 | ≥29.4 | ≥39.2 | ≥49.0 | ≥58.8 |

According to EN388 2016, a load is exerted on a sharp straight-edged blade, and by the maximum load, which can be exerted on the blade to ensure that a sample is not cut through after a 20-mm cutting distance of the blade, the cut resistance of the fabric can be classified into six levels of level A to level F, as listed in Table 2.

TABLE 2

| Cut level | A | B | C | D | E | F |
|---|---|---|---|---|---|---|
| Cutting force (N) | >2 | >5 | >10 | >15 | >22 | >30 |

Besides the comfort and flexibility, the fabric made of the multi-ply twisted yarn of the present invention has an extraordinary cut resistance and can be used for cut-resistant, comfortable and flexible protective products. The fabric made of the multi-ply twisted yarn where the core of the first single yarn comprises tungsten filaments is softer, more flexible, more comfortable and more cut-resistant than the fabric made of the multi-ply twisted yarn where the core of the first single yarn comprises steel filaments. The cutting force of the fabric of the present invention is at least greater than 29.4 N, corresponding to cut level A6 or above in ANSI/ISEA 105, preferably at least greater than 39.2 N, corresponding to cut level A7 or above in ANSI/ISEA 105, or at least greater than 30 N, corresponding to cut level F or above in EN388 2016.

It is believed that those skilled in the art can make the best of the present invention according to the previous description, without any further elaboration. Therefore, the following embodiments are only used for the illustration purpose, but not used to restrict the disclosure in any way.

Embodiments

The abbreviation "E" represents an embodiment, the abbreviation "CE" represent a comparative example, and the number following an abbreviation indicates the embodiment or comparative example in which the multi-ply twisted yarn and the corresponding cut-resistant fabric is made. Both the embodiments and the comparative examples are prepared and tested in a similar way.

Materials

Aromatic polyamide staple fibers (S): Kelvar® 970 poly-p-phenylene terephthamide staple fibers from DuPont Specialty Products US, LLC, with a length of about 3.8 cm and a fineness of about 1.6 dtex.

- tungsten filaments (C1): tungsten filaments from Xiamen Honglu Tungsten Molybdenum Industry Co., Ltd., with a diameter of about 20 μm, 25 μm, 30 μm, 35 μm, 40 μm and 43 μm, respectively;
- polyurethane elastomer filaments (C2): Lycra® 146 Spandex filaments with a fineness of about 44 dtex;
- steel filaments (M): 304L stainless steel filaments from Bekaert, with a diameter of about 50 μm.

Preparation of the First Single Yarn (Y1)

Feed aromatic polyamide staple fibers (S) into a standard carding machine for processing staple fiber ring spun yarns to produce carded slivers. Use double drawing (first drawing/final drawing) to process carded slivers into drawn slivers and process drawn slivers on a roving machine to produce roving yarns. Perform ring spinning for the two ends of roving yarns, embed tungsten filaments (C1) before twisting, and put the tungsten filaments (C1) between the two ends of the drawn roving yarns before the last extension roller to produce the first single yarn (Y1).

Preparation of the Second Single Yarn (Y2)

Feed aromatic polyamide staple fibers (S) into a standard carding machine for processing staple fiber ring spun yarns to produce carded slivers. Use double drawing (first drawing/final drawing) to process carded slivers into drawn slivers and process drawn slivers on a roving machine to produce roving yarns. Perform ring spinning for the two ends of roving yarns, embed polyurethane elastomer filaments (C2) just before twisting, put the polyurethane elastomer filaments (C2) between the two ends of the drawn yarns before the final extension roller, underfeed the materials at a speed lower than the final yarn speed and stretch polyurethane elastomer filaments (C2) to produce the second single yarn (Y2).

Preparation of the Comparative Single Yarn (Y3) Comprising Steel Filaments

Feed aromatic polyamide staple fibers (S) into a standard carding machine for processing staple fiber ring spun yarns to produce carded slivers. Use double drawing (first drawing/final drawing) to process carded slivers into drawn slivers and process drawn slivers on a roving machine to produce roving yarns. Perform ring spinning for the two ends of roving yarns, embed steel filaments (M) just before twisting, and put the steel filaments (M) between the two ends of the drawn roving yarns before the last extension roller to produce the comparative single yarn (Y3).

Preparation of Multi-Ply Twisted Yarn and Cut-Resistant Fabric

Ply the first single yarn (Y1) or the comparative single yarn (Y3) with the second single yarn (Y2), and then use a knitting method to produce different embodiments and comparative examples. Data related to the components of multi-ply twisted yarns, and the basic weights, cutting forces and cutting force indexes of cut-resistant fabrics in different embodiments is reported in Table 3.

Test Method

Basic weight: The basic weight in g/m$^2$ of a fabric is determined by dividing the weight of the fabric by the surface area of the fabric.

Cutting force: The cutting force is determined according to the standard method in ISO 13997.

Cutting force index: The cutting force index is obtained by dividing the cutting force by the basic weight of the cut fabric and then multiplying by 100.

Percentage variation (ΔP) of cutting force can be obtained according to the following equation:

$$\Delta P\% = [(P_n - P_0)/P_0] \times 100$$

where $P_0$ is the cutting force in a reference example, and $P_n$ is the cutting force used for a comparison in an embodiment.

Percentage variation (ΔA) of cutting force index can be obtained according to the following equation:

$$\Delta A\% = [(A_n - A_0)/A_0] \times 100$$

where $A_0$ is the cutting force index in a reference example, and $A_n$ is the cutting force index used for a comparison in an embodiment.

Cut level: The cut level of a fabric in ANSI/ISEA 105 (Table 1) and EN388 2016 (Table 2) is obtained according to the determined cutting force of the fabric.

Comfort: In order to test the comfort of the cut-resistant fabric of the present invention, multi-ply twisted yarns in different embodiments and comparative examples are knitted into glove samples. Not knowing the components of each glove sample, the tester tries on each glove. Then, the comfort of the gloves is evaluated as "good", "moderate" or "bad" according to their tightness and hardness.

From the results in Table 3, the depiction below is obvious.

When the fabric (CE2:Y1/Y2) made of the multi-ply twisted yarn where tungsten filaments (a diameter of 20 μm) are used as the core of the first single yarn is compared with the fabric (CE1:Y3/Y2) made of the multi-ply twisted yarn where steel filaments are used as the core of the first single yarn, the comfort increases from "moderate" to "good", the cutting force is improved by about 11%, but the cut level is still level A5 in ANSI/ISEA 105 or level E in EN388 2016.

When the fabric (CE3 and CE4:Y1/Y2) made of the multi-ply twisted yarn where tungsten filaments (diameters of 40 μm and 43 μm) are used as the core of the first single yarn is compared with the fabric (CE1:Y3/Y2) made of the multi-ply twisted yarn where steel filaments are used as the core of the first single yarn, the cutting force is improved by about 60% to 104%, the cutting force index is improved by about 42% to 52%, the cut level increases from level A5 to level A7-A8 in ANSI/ISEA 105 or from level E to level F in EN388 2016, but the comfort decreases from "moderate" to "bad".

When the fabric (E1-E3:Y1/Y2) made of the multi-ply twisted yarn where tungsten filaments (a diameter of 25 μm to 35 μm) are used as the core of the first single yarn is compared with the fabric (CE1:Y3/Y2) made of the multi-ply twisted yarn where steel filaments are used as the core of the first single yarn, it is unexpectedly found that the cutting force is improved by about 43% to 114%, the cutting force index is improved by about 76% to 84%, the cut level increases from level A5 to level A6-A8 in ANSI/ISEA 105 or from level E to level F in EN388 2016, and meanwhile, the comfort increases from "moderate" to "good". The fabric of the present invention has a very high cut resistance. In addition, when worn as a protective product, the fabric of the present invention is softer, more comfortable and more flexible.

TABLE 3

| Sample | CE1* | CE2 | E1 | E2 | E3 | CE3 | CE4 |
|---|---|---|---|---|---|---|---|
| Multi-ply twisted yarn | Y3/Y2 | Y1/Y2 | Y1/Y2 | Y1/Y2 | Y1/Y2 | Y1/Y2 | Y1/Y2 |
| Diameter of steel filaments (μm) | 50 | — | — | — | — | — | — |
| Diameter of tungsten filaments (μm) | — | 20 | 25 | 30 | 35 | 40 | 43 |
| Number of needles | 13 | 20 | 18 | 13 | 13 | 13 | 13 |
| Comfort | Moderate | Good | Good | Good | Good | Bad | Bad |
| Basic weight (g/m$^2$) | 265 | 174 | 214 | 292 | 313 | 297.7 | 354.9 |
| Cutting force P (N) | 25.5 | 28.2 | 36.4 | 51.7 | 54.6 | 40.9 | 52.1 |
| AP(%) | — | 11% | 43% | 103% | 114% | 60% | 104% |
| Cut level in ANSI/ISEA 105 | A5 | A5 | A6 | A8 | A8 | A7 | A8 |
| Cut level in EN388 2016 | E | E | F | F | F | F | F |
| Cutting force index A(N/g/m$^2$) | 9.64 | 16.21 | 16.94 | 17.73 | 17.44 | 13.7 | 14.7 |
| ΔA(%) | — | 68% | 76% | 84% | 81% | 42% | 52% |

*indicates that CE1 is a reference example used for calculating the percentage variations between CE1 and E1 to E3 or between CE1 and CE2 to CE4.

In one embodiment of the present invention, the multi-ply twisted yarn for a cut-resistant fabric comprises:

(i) at least a first single yarn having a skin-core structure, wherein the skin comprises aromatic polyamide staple fibers and the core comprises tungsten filaments with a diameter of 25 μm to 35 μm, and (ii) at least a second single yarn having a skin-core structure, wherein the skin comprises aromatic polyamide staple fibers, and the core comprises at least a polyurethane elastomer filament.

Although the present invention has been explained and described in the typical embodiments, the present invention is not limited to the shown details. This is because various modifications and replacements may be made without departing from the spirit of the present invention. Therefore, the modifications and equivalents to the present invention disclosed here can be obtained by those skilled in the art only by use of conventional experiments, and all these modifications and equivalents fall within the spirit and scope defined by the claims of the present invention.

The invention claimed is:

1. A multi-ply twisted yarn for a cut-resistant fabric, characterized in that the yarn comprises:

(i) at least a first single yarn having a skin-core structure, wherein the skin comprises aromatic polyamide staple fibers and the core comprises tungsten filaments, and (ii) at least a second single yarn having a skin-core structure, wherein the skin comprises cut-resistant staple fibers, the core comprises at least an elastomer filament, and the cut-resistant staple fibers of the second single yarn are selected from one or more of aromatic polyamide staple fibers, aliphatic polyamide staple fibers and polyethylene staple fibers, wherein the tungsten filaments have a diameter of 25 μm to 35 μm; and wherein a fabric having a basis weight of 214 to 313 g/m$^2$ knitted from said multi-ply twisted yarn has a cutting force index of 16.94 N/g/m$^2$ or greater, and a cut level that is higher than or equal to ANSI/ISEA 105 level A6.

2. The multi-ply twisted yarn as claimed in claim 1, characterized in that the elastomer filament is a polyurethane elastomer filament and the linear density of the elastomer filament is 22 dtex to 220 dtex.

3. The multi-ply twisted yarn as claimed in claim 1, characterized in that the twist factor of the multi-ply twisted yarn is 200 twist per meter (TPM) to 400 TPM and the linear density is 240 dtex to 850 dtex.

4. A cut-resistant fabric, comprising the multi-ply twisted yarn as claimed in claim 1, the cut-resistant fabric having a cutting force index of 16.94 N/g/m$^2$ or greater, and a cut level that is higher than or equal to ANSI/ISEA 105 level A6.

5. The cut-resistant fabric as claimed in claim 4, characterized in that the cut-resistant fabric is a knitted fabric.

6. The cut-resistant fabric as claimed in claim 5, characterized in that the cut-resistant fabric has a basic weight of 200 g/m$^2$ to 400 g/m$^2$.

7. A protective product, comprising the cut-resistant fabric as claimed in claim 4.

8. The protective product as claimed in claim 7, characterized in that the protective product is a protective glove, protective clothing, a protective vest, a protective cap, an armguard, a protective blanket, a protective curtain, a protective shoe, work clothing, or sports wear.

9. A protective product, comprising the cut-resistant fabric as claimed in claim 5.

10. The protective product as claimed in claim 9, characterized in that the protective product is a protective glove, protective clothing, a protective vest, a protective cap, an armguard, a protective blanket, a protective curtain, a protective shoe, work clothing, or sports wear.

11. A protective product, comprising the cut-resistant fabric as claimed in claim 6.

12. The protective product as claimed in claim 11, characterized in that the protective product is a protective glove, protective clothing, a protective vest, a protective cap, an armguard, a protective blanket, a protective curtain, a protective shoe, work clothing, or sports wear.

* * * * *